US006244665B1

(12) United States Patent
Bise et al.

(10) Patent No.: US 6,244,665 B1
(45) Date of Patent: Jun. 12, 2001

(54) CUTTING TOOLHOLDER WITH RECESSED GROOVE FOR CUTTING TOOL REMOVAL

(75) Inventors: Douglas E. Bise; Phillip W. Haga, both of Chilhowie, VA (US); Randall W. Oianen, Bristol, TN (US)

(73) Assignee: Kennametal PC Inc., Monrovia, CA (US)

( * ) Notice: Subject to any disclaimer, the term of this patent is extended or adjusted under 35 U.S.C. 154(b) by 0 days.

(21) Appl. No.: 09/251,566

(22) Filed: Feb. 17, 1999

(51) Int. Cl.[7] ..... E21C 35/18

(52) U.S. Cl. ..... 299/106; 299/79.1; 299/110; 403/11

(58) Field of Search ..... 403/11, 16; 299/100, 299/104, 79.1, 106, 108, 110; 29/243

(56) References Cited

U.S. PATENT DOCUMENTS

| | | | | |
|---|---|---|---|---|
| D. 420,013 | * | 2/2000 | Warren et al. | D15/21 |
| 3,268,260 | | 8/1966 | Snipe | 299/91 |
| 3,833,265 | | 9/1974 | Elders | 299/86 |
| 4,149,753 | | 4/1979 | Stoltz et al. | 299/91 |
| 4,251,109 | | 2/1981 | Roepke | 299/12 |
| 4,298,233 | | 11/1981 | Elfgen | 299/91 |
| 4,627,665 | | 12/1986 | Ewing et al. | 299/79 |
| 4,736,533 | | 4/1988 | May et al. | 37/141 |
| 4,938,538 | | 7/1990 | Larsson et al. | 299/86 |
| 5,018,793 | | 5/1991 | Den Besten | 299/86 |
| 5,374,111 | | 12/1994 | Den Besten et al. | 299/86 |
| 5,632,527 | * | 5/1997 | Halder | 299/100 |
| 6,099,081 | | 8/2000 | Warren et al. | 299/104 |

FOREIGN PATENT DOCUMENTS

| | | |
|---|---|---|
| 3401243 | 8/1984 | (DE) . |
| 729796 | 12/1953 | (GB) . |

OTHER PUBLICATIONS

Krampe & Co. GmbH, Advertisement entitled "HEX–BORE–52 System," (undated), (1 page).

Krampe & Co., Advertisement entitled "HEX–BORE Block/Sleeve Parallel Shank Tool System from Krampe," Glückhauf 134 (1998) Nr. 7/8, (1 page), with English translation (3 pages).

* cited by examiner

*Primary Examiner*—David Bagnell
*Assistant Examiner*—John Kreck
(74) *Attorney, Agent, or Firm*—Kevin P. Weldon

(57) ABSTRACT

A toolholder for securing a cutting tool used for mining and construction applications whereby the holder has a recessed groove to provide access to the underside of a flange on the cutting bit to promote removal of the cutting tool from the toolholder.

12 Claims, 3 Drawing Sheets

CUTTING TOOLHOLDER WITH RECESSED GROOVE FOR CUTTING TOOL REMOVAL

BACKGROUND OF THE INVENTION

1. Field of the Invention

This invention relates to a toolholder for holding a cutting tool. More particularly, this invention relates to a toolholder for holding a cutting tool in which the toolholder has a recessed groove to expose a portion of the underside of a flange on the cutting tool to assist in the removal of the cutting tool from the toolholder.

2. Description of the Prior Art

Rotatable cutting tools in toolholders have been common in the mining and construction industry for many years. However, one difficulty with these cutting tools occurs when the cutting tool is damaged or worn out and must be removed from the toolholder for replacement. One method for removing such a cutting tool involves striking the rear of the tool through the holder bore. However, on many machines using such toolholders, access to the rear of the holder bore is limited. A second method for removing the cutting tool involves the use of a hydraulic cylinder and pressure device which utilizes a wrench that slides into a groove on the head of the tool which by striking, physically forces the cutting tool from the toolholder. Both of these methods are slow and require extra equipment. Furthermore, both of these methods require an operator with training and experience.

U.S. application Ser. No. 09/166,634, filed Oct. 5, 1998 entitled "Cutting Bit Support Member With Undercut Flange For Removal" is co-pending and directed to a sleeve or a block for holding a cutting tool whereby the sleeve or block has an undercut portion to ease removal of the sleeve from a toolholder or removal of the block from a holder.

U.S. Pat. No. 5,374,111 entitled "Extraction Undercut For Flange Bits" and assigned to Kennametal Inc., the assignee of the current application, is hereby incorporated by reference and addresses the use of a rotatable cutting tool having a flange with an undercut whereby the undercut may be employed in conjunction with a prying tool to remove the rotatable cutting tool from the toolholder. Although it is relatively common to employ some sort of prying tool to physically remove a cutting bit from a toolholder, and such an undercut makes the removal of the cutting bit easier, the amount of material removed from the flange to form the undercut in limited because the structural integrity of the flange must be maintained when the force of the prying tool is applied against the flange.

The inventors of the subject application, realizing the need for easier removal of cutting tools from toolholders without removing material from the cutting bit flange, have sought a solution.

SUMMARY OF THE INVENTION

The invention is directed toward a holder for retaining a cutting tool having a shank with an outside diameter and a tool mounting flange integral with the shank wherein the flange has a greater outside diameter than the shank outside diameter thereby defining a shoulder with a tool mounting surface. The holder comprises a body having a forward end and a cylindrical bore extending rearwardly therein along a longitudinal axis to define a bore wall and to receive the cutting tool shank at the forward end of the holder and a generally planar face on the body circumscribing the bore and extending radially away from the bore to an outer wall, wherein the planar face of the body may contact the tool mounting surface of the cutting tool.

A portion of the outer wall adjacent to the planar face is recessed to form an access groove thereby providing access for a removal tool to contact a portion of the tool mounting surface when the cutting tool is mounted within the holder.

DESCRIPTION OF THE PREFERRED EMBODIMENT

Figure 1:
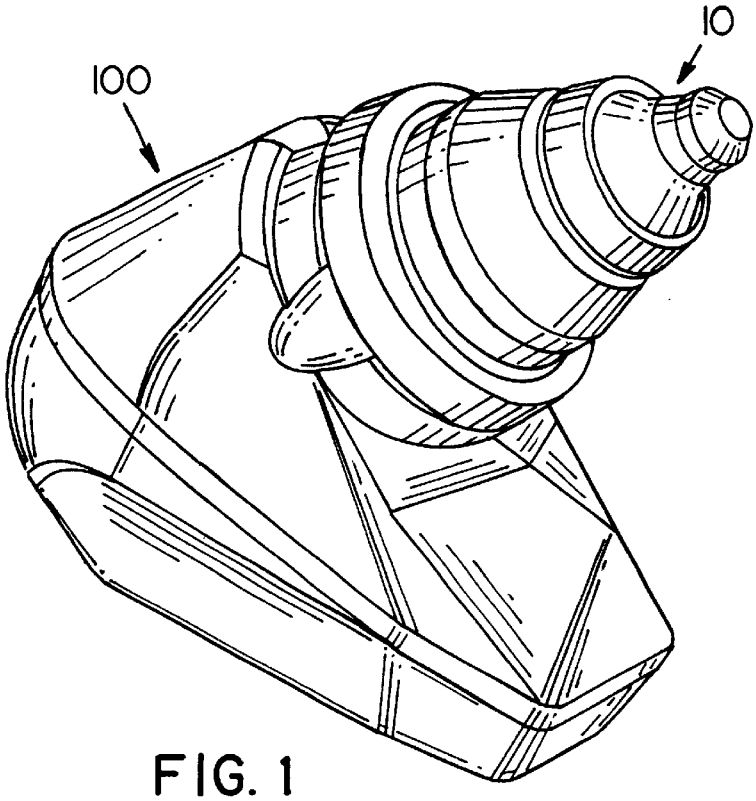
FIG. 1 is a perspective view of an assembled cutting tool and toolholder in accordance with the subject invention.

FIG. 1 illustrates a cutting tool 10, which is secured within a toolholder 100. The toolholder 100 is secured, for example, to a rotating drum (not shown) which may be used in mining or construction applications.

Figure 2:
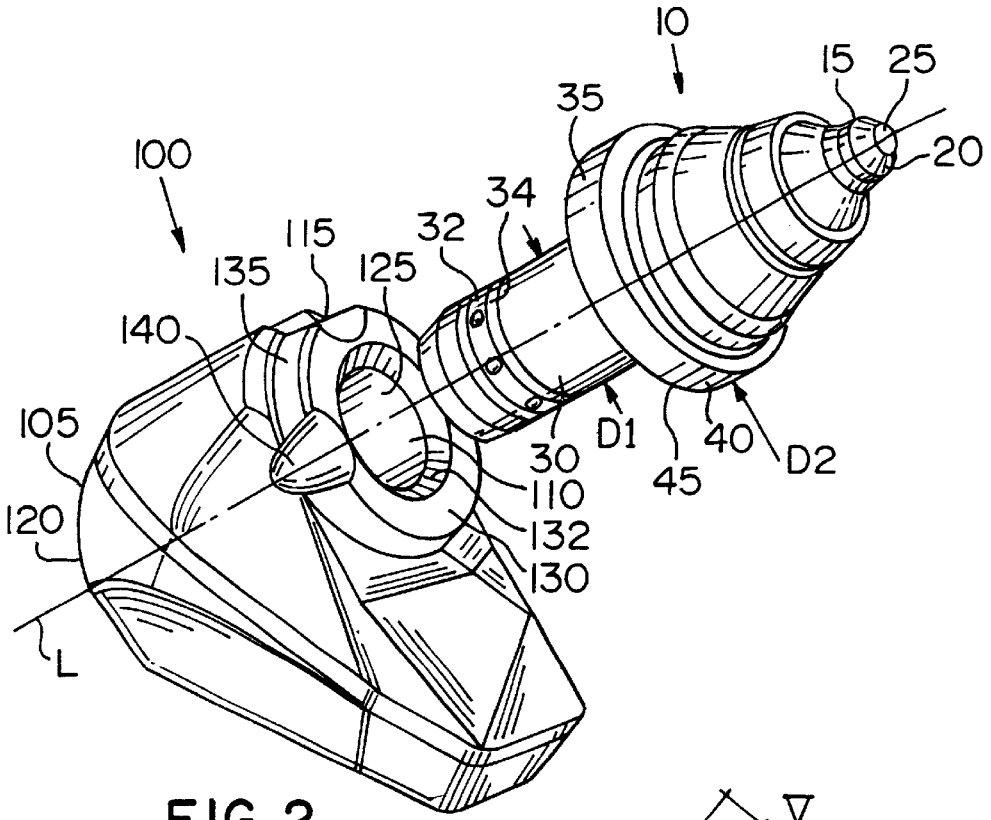
FIG. 2 is an exploded perspective view of the arrangement illustrated in FIG. 1.

FIG. 2 illustrates an exploded perspective view of the same arrangement in FIG. 1. The cutting tool 10 generally includes a working head 15, having a head portion 20, which may be conical, and a tip 25 comprising a material such as cemented carbide or other hard material generally known in the field of mining and construction. A shank 30 of the cutting tool 10 is mounted within a cylindrical bore 110 of the toolholder 100 and secured therein by a retainer clip 32, which is recessed within a groove 34 in the shank 30. The shank 30 has an outside diameter D1 and a tool mounting flange 35, which has a diameter D2 that is greater than the shank outside diameter D1 thereby defining a shoulder 40 with a tool mounting surface 45.

The toolholder 100 is comprised of a body 105 having the cylindrical bore 110 extending from a forward end 115 rearwardly toward a rearward end 120 along a longitudinal axis L to define a bore wall 125 and to receive the cutting tool shank 30.

The body 105 has a generally planar face 130 circumscribing the bore 110 at the forward end 115 extending radially away from the cylindrical bore 110 to an outer wall 135. The planar face 130 of the body 105 may contact the tool mounting surface 45 of the cutting tool 10. A portion of the outer wall 135, adjacent to the planar face 130, is recessed to form an access groove 140. The access groove 140 provides access for a removal tool (not shown) to contact a portion of the tool mounting surface 45 and to assist in removing the cutting tool 10 from the toolholder 100. The width of the access groove 140 at the outer wall 135 is less than the diameter of the bore 110.

A typical removal tool would be a rod used as a punch. The rod is placed against the tool mounting surface 45 and then the rod is struck with a hammer to impart a force against the tool mounting surface 45 thereby displacing the cutting tool 10 from the toolholder 100.

Figure 3:
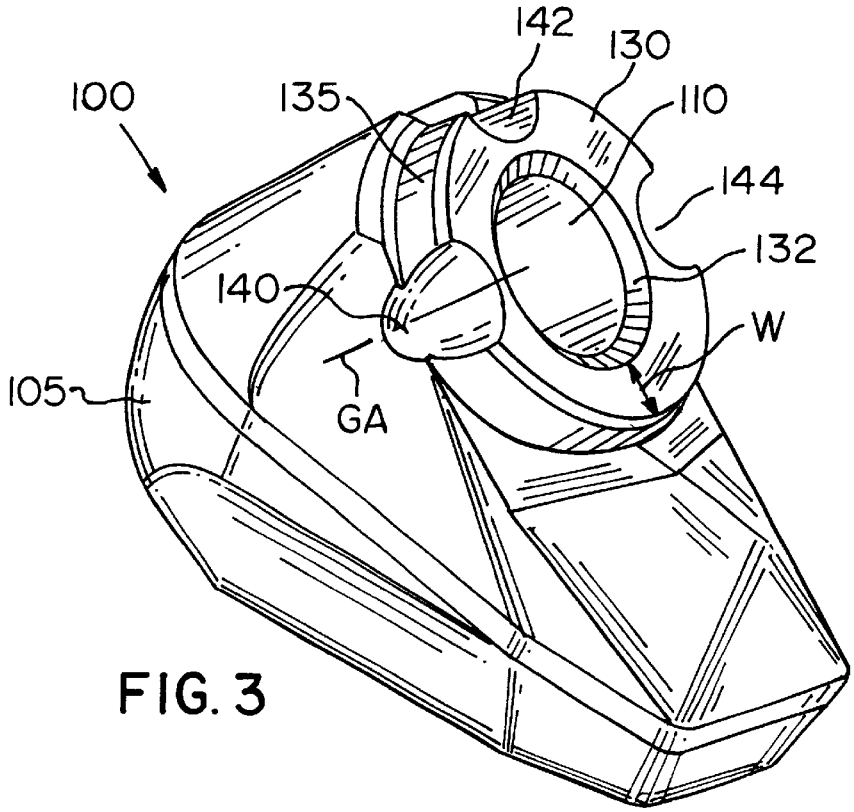
FIG. 3 is a perspective view of only the toolholder illustrated in FIG. 2.

Although only a single groove 140 is needed for access by a removal tool, additional grooves may be included at different locations for providing different access points for the removal tool to contact the tool mounting surface 45 (FIG. 2) of the cutting tool 10. As illustrated in FIG. 3, multiple portions of the outer wall 135 of the toolholder 100 may be recessed to form multiple access grooves 140, 142, 144.

As shown in FIG. 3, the planar face 130 of the toolholder 100 has a width W and the groove 140 penetrates the planar face 130 to a depth of between 30–100% of the width W.

Preferably, the groove penetrates the planar face 130 to a depth of a approximately 75% of the width W.

The access groove 140, when viewed along its groove axis GA, is generally arcuate in shape, as illustrated in FIG. 3. However, it should be appreciated that the groove may have many other shapes, including rectangular, when viewed along the same axis so long as access is provided to the tool mounting surface 45 of the cutting tool 10 to promote removal of the cutting tool 10.

Figure 4:
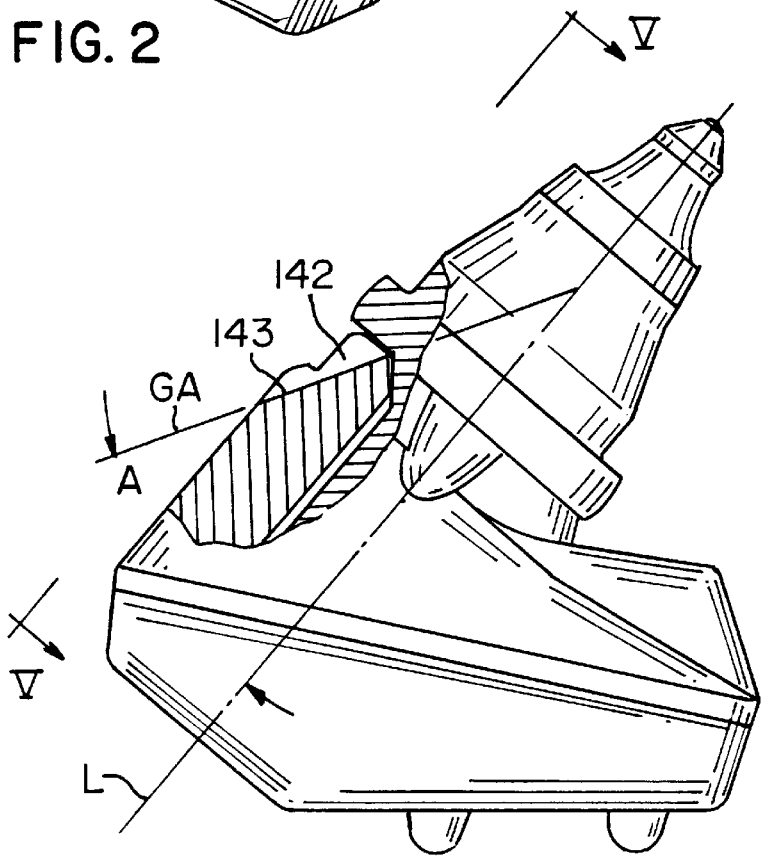
FIG. 4 is a side view of the cutting tool and toolholder illustrated in FIG. 1 with a partial cross section showing internal details.

FIG. 4 illustrates a side view with a section removed showing details of the access groove 142 illustrated in FIG. 3. The details of this groove 142 are identical to those of groove 140 which was previously discussed.

The access groove 142, when viewed from the side as in FIG. 4, defines a groove axis GA along a surface 143 of the groove 142. The groove axis GA forms a penetration angle A of between 20°–80° with the longitudinal axis L. A penetration angle A of 30° is preferred.

Figure 5:
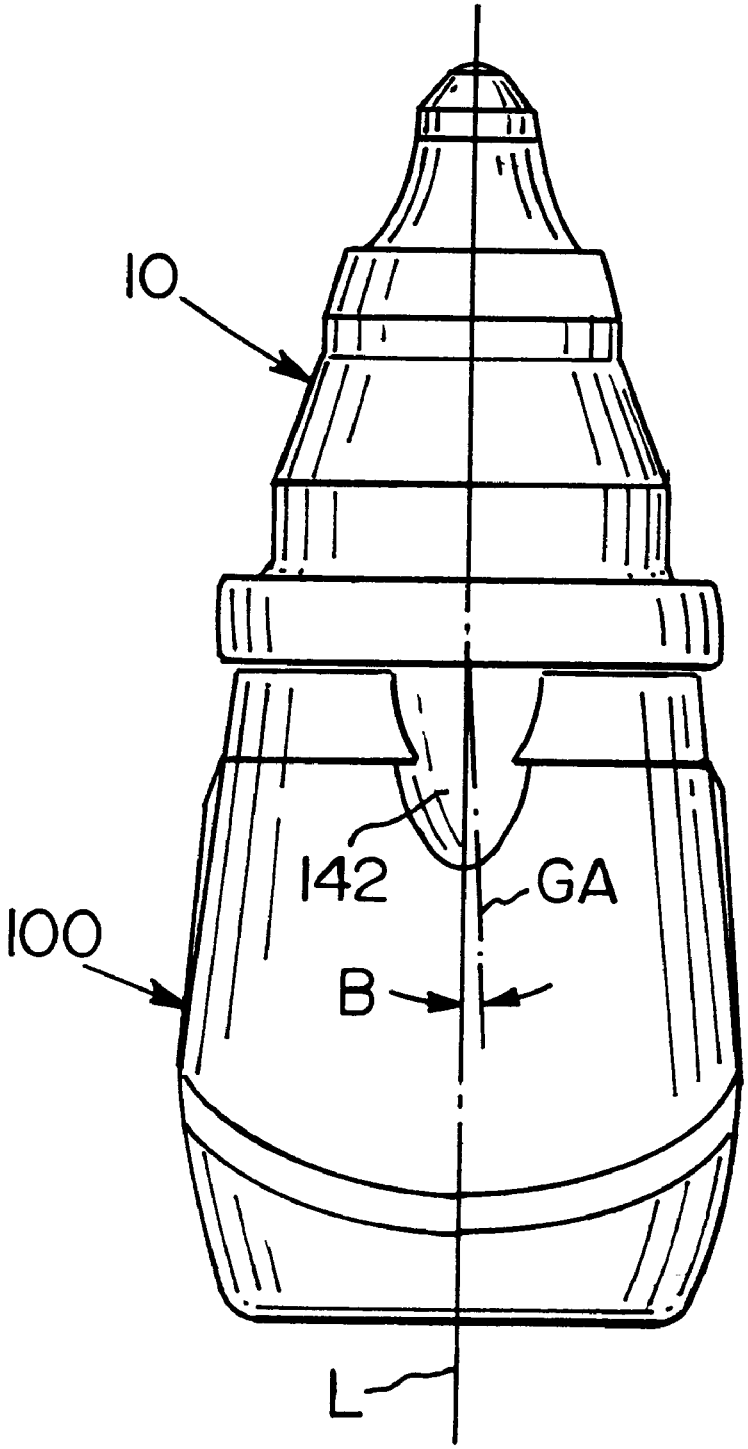
FIG. 5 is a side view of the cutting tool and toolholder taken along lines "5—5" in FIG. 4.

FIG. 5 shows a side view of the apparatus in FIG. 4 along arrows "5—5" in FIG. 4. It should be noted that FIG. 5 is a full view and the portion removed in the sectional view in FIG. 4 has been restored. When looking at the side of the toolholder 100, as seen in FIG. 5, the groove axis GA is defined by a line bisecting the groove 142. The projection of the groove axis GA in FIG. 5 with the longitudinal axis L forms an orientation angle B which may be between 0°–30° and is preferably 30°.

The present invention may be carried out in other specific ways different from those herein set forth without departing from the spirit and the essential characteristics of the invention. The present embodiment is therefore to be considered in all respects as illustrative and not restricted and all changes coming within the meaning of the equivalency range of the appended claims are intended to be embraced therein.

What is claimed:

1. A holder for retaining a cutting tool wherein the cutting tool has a shank with an outside diameter and a tool mounting flange integral with the shank wherein the tool mounting flange has a greater outside diameter than the shank outside diameter thereby defining a shoulder with a tool mounting surface, wherein the holder comprises:

a) a body having a forward end and a cylindrical bore extending rearwardly therein along a longitudinal axis to define a bore wall and to receive the cutting tool shank at the forward end of the holder;

b) a generally planar face on the body circumscribing the bore and extending radially away from the bore to an outer wall, wherein the planar face of the body may contact the tool mounting surface of the cutting tool;

c) wherein a portion of the outer wall adjacent to the planar face is recessed to form an access groove, and d) wherein the width of the access groove at the outer wall is less than the diameter of the bore of the body, thereby providing access for a removal tool to contact a portion of the tool mounting surface when the cutting tool is mounted within the holder.

2. The holder according to claim 1, wherein multiple portions of the outer wall are recessed to form multiple grooves.

3. The holder according to claim 1, wherein the access groove defines a groove axis which follows the surface of the groove and forms with the longitudinal axis a penetration angle (A) of between 20°–80°.

4. The holder according to claim 3, wherein the penetration angle (A) is 30°.

5. The holder according to claim 1, wherein the access groove defines a groove axis which bisects the groove and forms with the longitudinal axis an orientation angle (B) of between 0°–30°.

6. The holder according to claim 5, wherein the orientation angle (B) is 30°.

7. The holder according to claim 5, wherein the groove is generally arcuate when viewed along the groove axis from the planar face of the toolholder body into the bore.

8. The holder according to claim 5, wherein the groove is generally rectangular in shape when viewed along the groove axis from the planar face of the toolholder body into the bore.

9. The holder according to claim 1, wherein the planar face of the body has a width (W) and the groove penetrates the planar face to a depth of between 30–100% of the width (W).

10. The holder according to claim 9, wherein the groove penetrates the planar face to a depth of 75% of the width (W).

11. An assembly comprised of:

a) a cutting tool having a shank with an outside diameter and a tool mounting flange integral with the shank, wherein the tool mounting flange has a greater outside diameter than the shank outside diameter thereby defining a shoulder with a tool mounting surface;

b) a holder having:

i) a body having a cylindrical bore extending rearwardly therein along a longitudinal axis to define a bore wall and to receive the cutting tool shank;

ii) a generally planar face on the body circumscribing the bore and extending radially away from the bore to an outer wall, wherein the planar face of the body may contact the tool mounting surface of the cutting tool; and iii) wherein a portion of the outer wall adjacent to the planar face is recessed to form an access groove and wherein the width of the access groove at the outer wall is less than the diameter of the bore of the body, thereby providing access for a removal tool to contact a portion of the tool mounting surface when the cutting tool is mounted within the holder.

12. A holder for retaining a cutting tool wherein the cutting tool has a shank and with an outside diameter and a tool mounting flange integral with the shank wherein the tool mounting flange has a greater outside diameter than the shank outside diameter thereby defining a shoulder with a tool mounting surface, wherein the holder comprises:

a) a body having a forward end and a cylindrical bore extending rearwardly therein along a longitudinal axis to define a bore wall and to receive the cutting tool shank at the forward end of the holder;

b) a generally planar face on the body circumscribing the bore and extending radially away from the bore to an outer wall, wherein the planar face of the body may contact the tool mounting surface of the cutting tool;

c) wherein a portion of the outer wall adjacent to the planar face is recessed to form an access groove, providing access for a removal tool to contact a portion of the tool mounting surface when the cutting tool is mounted within the holder, and d) wherein the access groove defines a groove axis which bisects the groove and forms with the longitudinal axis an orientation angle (B) of 30°.

* * * * *